US010920553B2

(12) United States Patent
Hodgson et al.

(10) Patent No.: US 10,920,553 B2
(45) Date of Patent: Feb. 16, 2021

(54) APPARATUS AND METHOD FOR SERVICING A WELL

(71) Applicant: SCHLUMBERGER TECHNOLOGY CORPORATION, Sugar Land, TX (US)

(72) Inventors: Kim A. Hodgson, Sugar Land, TX (US); Sean Black, Brisbane (AU); Prashant Unnikrishnan Nair, Northern Ireland (GB); Dale Eden, Conroe, TX (US); William Troy Huey, Denver, CO (US); Donald E. Hensley, Sugar Land, TX (US); Olivier Clerc, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/507,416

(22) Filed: Jul. 10, 2019

(65) Prior Publication Data

US 2019/0376377 A1 Dec. 12, 2019

Related U.S. Application Data

(62) Division of application No. 14/655,114, filed as application No. PCT/US2013/076606 on Dec. 19, 2013, now Pat. No. 10,385,669.

(Continued)

(51) Int. Cl.
*E21B 43/00* (2006.01)
*E21B 43/26* (2006.01)
(Continued)

(52) U.S. Cl.
CPC ..... *E21B 43/26* (2013.01); *B01F 3/12* (2013.01); *B01F 3/1271* (2013.01);
(Continued)

(58) Field of Classification Search
CPC .. B01F 2215/0081; B01F 3/12; B01F 3/1271; B01F 7/00341; B01F 13/0037;
(Continued)

(56) References Cited

U.S. PATENT DOCUMENTS 4,265,266 A 5/1981 Kierbow et al.
4,311,395 A 1/1982 Douthitt et al.
(Continued)

FOREIGN PATENT DOCUMENTS

WO 2012051309 A2 4/2012

*Primary Examiner* — Anshu Bhatia
(74) *Attorney, Agent, or Firm* — Rodney Warfford

(57) ABSTRACT

A blender apparatus is disclosed having a chassis, a mixer positioned on the chassis, and a transfer pump positioned on the chassis. The mixer has a mixer housing defining a first mixer inlet, a second mixer inlet, and a mixer outlet. The first mixer inlet receives a liquid component, and the second mixer inlet receives a dry component. The mixer pressurizes at least the liquid component within the housing and discharges the liquid component through the mixer outlet at a first pressure above hydrostatic pressure. The transfer pump has a pump housing defining a pump inlet, a pump outlet and is devoid of an inlet configured to receive a dry component through a gravity feed. The transfer pump receives the liquid component through the pump inlet, pressurizes the liquid component within the pump housing, and discharges the liquid component through the pump outlet at a second pressure above hydrostatic pressure.

13 Claims, 3 Drawing Sheets

Related U.S. Application Data

(60) Provisional application No. 61/746,231, filed on Dec. 27, 2012.

(51) Int. Cl.

| | |
|---|---|
| ***B01F 15/02*** | (2006.01) |
| ***B01F 3/12*** | (2006.01) |
| ***B01F 7/00*** | (2006.01) |
| ***B01F 13/00*** | (2006.01) |
| ***E21B 21/06*** | (2006.01) |
| ***E21B 43/267*** | (2006.01) |

(52) U.S. Cl.
CPC ..... *B01F 7/00341* (2013.01); *B01F 13/0037* (2013.01); *B01F 15/026* (2013.01); *B01F 15/0234* (2013.01); *B01F 15/0243* (2013.01); *E21B 21/062* (2013.01); *E21B 43/267* (2013.01); *B01F 2215/0081* (2013.01)

(58) Field of Classification Search
CPC ..... B01F 15/0234; B01F 15/0243; B01F 15/026; E21B 43/26; E21B 21/062; E21B 43/267
See application file for complete search history.

(56) References Cited

U.S. PATENT DOCUMENTS

| | | | | |
|---|---|---|---|---|
| 4,448,535 | A | 5/1984 | West | |
| 4,453,829 | A | 6/1984 | Althouse, III | |
| 4,614,435 | A | 9/1986 | McIntire | |
| 4,802,141 | A | 1/1989 | Stegemoeller et al. | |
| 4,834,542 | A | 5/1989 | Sherwood | |
| 4,850,704 | A * | 7/1989 | Zimmerly ..... | B01F 5/162 366/263 |
| 4,915,505 | A | 4/1990 | Arribau et al. | |
| 6,644,844 | B2 | 11/2003 | Neal et al. | |
| 2008/0236818 | A1 | 10/2008 | Dykstra | |
| 2011/0067885 | A1 | 3/2011 | Shampine et al. | |
| 2012/0085541 | A1 | 4/2012 | Love et al. | |

* cited by examiner

APPARATUS AND METHOD FOR SERVICING A WELL

RELATED APPLICATION INFORMATION

This application is a divisional of U.S. Patent Application Publication No. 2015/0322761, filed Jun. 24, 2015, which is a national stage entry of International Patent Application No. PCT/US2013/076606, filed Dec. 19, 2013, which claims the benefit of U.S. Provisional Patent Application Ser. No. 61/746,231, filed on Dec. 27, 2012.

TECHNICAL FIELD

The present disclosure generally relates to systems, apparatuses, or methods of mixing and metering proppant into fracturing fluid to be injected into a wellbore.

BACKGROUND

In the oil and gas industry, a subterranean formation (i.e. a "reservoir") is often treated (or "stimulated") to enhance or restore the productivity of a well. Typically, a large number of well related vehicles and equipment are used at a well site during a treatment operation. Stimulation treatment operations may include, for example, blending units, pump units, manifold trailers, acid injection units, proppant transport units, and other types of equipment for numerous potential procedures. Typically, each type of equipment or unit is mounted on its own vehicle and trailer, or set of vehicles and trailers, and operated by a crew dedicated to that particular type of equipment.

Preparation of the area around the wellhead often is dictated by the number and size of equipment desired for a given project. Each vehicle type and corresponding crew should have sufficient room at the well site to access the well during its specific procedure. Downtime can occur between some operations while waiting for the arrival of crews to handle specific procedures in a desired sequence during the oilfield operation.

In hydraulic fracturing, fracturing fluid is injected into a wellbore, penetrating a subterranean formation and forcing the fracturing fluid at pressure to crack and fracture the strata or rock. Proppant is placed in the fracturing fluid and thereby placed within the fracture to form a proppant pack to prevent the fracture from closing when pressure is released, providing improved flow of recoverable fluids, i.e., oil, gas, or water. The success of a hydraulic fracturing treatment is related to the fracture conductivity which is the ability of fluids to flow from the formation through the proppant pack. In other words, the proppant pack or matrix may have a high permeability relative to the formation for fluid to flow with low resistance to the wellbore. Permeability of the proppant matrix may be increased through distribution of proppant and non-proppant materials within the fracture to increase porosity within the fracture.

Prior to injection of the fracturing fluid, the proppant and other components of the fracturing fluid may be blended. Hydraulic fracturing operations may blend and pump more than 3 million pounds or 1.3 million kilograms of proppant or dry components per day at a wellsite. Proppant is often stored in silos or other types of units on site, which deliver the proppant into a hopper associated with a blending unit. The proppant is then metered from the hopper into a mixer.

Dry components, such as proppants, and liquid components, such as gels, may be blended into the fracturing fluid, often referred to as a slurry, in a blender. Blenders, such as the blender described in U.S. Pat. No. 4,453,829, may have slinger elements of a toroidal configuration with a concave upper surface. Several upstanding blade members are mounted on the concave surface of this slinger and an impeller member is attached to the underside of the slinger. The slinger and impeller are enclosed within a housing and fastened to the end of a drive shaft rotated by a motor mounted above the housing. A hopper is mounted above an inlet eye in the top of the housing, for introducing sand or other solid particles or dry components into the housing. At the bottom of the housing is a suction eye inlet, for drawing fluid or liquid components into the housing and the resulting fluid-solid mixture is discharged through an outlet port in the housing.

In the operation of the blender described above, sand flows out of the hopper and drops onto the rotating slinger through the inlet eye in the housing. With the impeller and slinger rotating at the same speed, the vortex action of the impeller creates a suction force that draws liquid into the casing through the suction eye inlet. As the liquid is pulled into the casing it is pressurized by the impeller and mixed thoroughly with the sand being flung outwardly, in a centrifugal action, from the slinger. The sand-liquid mixture is then continuously discharged, under pressure, through the outlet port, from which it is carried into the pump unit and injected into a well. Some blenders, such as the one described above, may cause air within the dry component to become entrained in the slurry.

Other blenders, such as the one described in U.S. Pat. No. 4,614,435, are designed to mix dry components with fluid components without entraining air into the resulting slurry. The dry components are contained in a hopper mounted above the inlet eye of a housing member. The outlet end of the hopper sets above the inlet eye to provide an exterior air exhaust space at this point on the blender. The housing encloses a slinger and impeller member that is fastened to the underside surface of the slinger.

The impeller and slinger are both fastened to the bottom end of a drive shaft that extends up through the inlet eye of the housing to a motor that rotates the shaft. The slinger has a toroidal configuration and a topside concave surface that faces toward the top of the housing. The underside surface of the slinger has a recess in it and the recess defines an interior air exhaust space between the slinger and impeller. The slinger also has one or more interior air exhaust channels that extend from the air exhaust space between the slinger and impeller up to the topside surface of the slinger. To obtain a desired pressure output of 60 to 80 PSI (Pounds per Square Inch), the slinger and impeller may be rotated at a speed between 1,200 and 1,400 RPM (Revolutions per Minute). The high rotational speed in conjunction with the abrasive nature of the proppant being agitated by the impeller and slinger causes erosion on the impeller and slinger components and often causes the blender to wear out, necessitating frequent maintenance and rebuilding.

In addition to the above mentioned blenders that provide a pressurized output above hydrostatic pressure, tub blenders are also used. Tub blenders separate the mixing and pumping operations. A tub mixer delivers proppant and fluid into a large tub which contains an agitation mechanism, such as a rotational paddle or horizontal ribbon mixer. Mixing of the dry component and liquid component occurs in this tub at hydrostatic pressure due to gravity, and a centrifugal pump then takes fluid from the bottom of the tub and discharges the fluid under pressure at about 80 PSI to high pressure fracturing pumps or a manifold trailer connected to the pumps.

Further, some blenders use centrifugal pumps to pump clean liquid components into a closed tub with a rotating slinger at the top of the tub. The centrifugal pump pressurizes the entire tub, and the slinger introduces and mixes the dry component into the liquid component to create the slurry. The slurry then exits the tub at a tangential discharge point in the housing. The slinger within the tub does not impart energy to the slurry above the energy received from the centrifugal pump as a result of the centrifugal pump pressurizing the tub.

In any type of blender used for creating the slurry, there are components that undergo erosion and wear due to the highly abrasive nature of the proppant within the slurry. Additionally, some blenders may also present issues with respect to maintaining sufficient discharge pressure to the high pressure pumps or manifold. The high pressure pumps may be located on the wellsite at a considerable distance from the blender unit, at times being over 150 ft or over 45 m away from the blender. The pressure drop through the hose extending between the blender unit and the high pressure pump or manifold may cause insufficient suction pressure conditions at the high pressure pumps thereby causing undue wear on the high pressure pumps due to starvation or cavitation.

Blenders are typically employed to mix components of a fracturing fluid together in a single blender. Fiber products have traditionally been difficult to handle and meter at the desired concentrations in both stimulation and cementing work. Reliability problems that typically arise with the existing fiber metering and delivery systems include the fiber jamming the metering equipment and plugging conveyance chutes. Thus, a separate fiber-to-liquid component interface is desirable that prevents plugging and is not subject to the restrictive geometry of current fiber chutes.

SUMMARY

In one version of the present disclosure, a well stimulation system is described. The well stimulation system has at least one blending system, a manifold in fluid communication with the at least one blending system, and a stimulation pump fluidly connected to the manifold. The at least one blending system has a blender apparatus with a chassis, at least one mixer positioned on the chassis, at least one transfer pump positioned on the chassis, and at least two fluid discharge ports. The mixer has a mixer housing defining a first mixer inlet, a second mixer inlet, and a mixer outlet. The first mixer inlet receives a liquid component, and the second mixer inlet receives a dry component. The mixer pressurizes at least the liquid component within the housing and discharges the liquid component through the mixer outlet at a first pressure above hydrostatic pressure. The at least one transfer pump has a pump housing defining a pump inlet to receive a liquid component, a pump outlet, and is devoid of an inlet for receiving a dry component through a gravity feed. The at least one transfer pump receives the liquid component, pressurizes the liquid component within the housing, and discharges the liquid component through the pump outlet at a second pressure above hydrostatic pressure. The at least two fluid discharge ports include a first discharge port in fluid communication with the mixer outlet and a second discharge port in fluid communication with the pump outlet. The manifold has a plurality of inlets and a plurality of outlets. The manifold is connected to the at least two discharge ports of the at least one blender apparatus via at least one of the plurality of inlets, and fluidly connected to a well-bore, via at least one of the plurality of outlets, for directing the liquid component into the well-bore. The stimulation pump has an inlet fluidly connected to at least one of the plurality of outlets of the manifold to receive the liquid component, and an outlet fluidly connected to the at least one of the plurality of inlets of the manifold to pass the liquid component back to the manifold at a third pressure above the first and second pressures.

In one version of the present disclosure, a blending system is described as having a chassis, and a blending apparatus. The blending apparatus has a mixer positioned on the chassis and a transfer pump positioned on the chassis. The mixer has a mixer housing defining a first mixer inlet, a second mixer inlet and a mixer outlet. The first mixer inlet receives a liquid component, and the second mixer inlet receives a dry component. The mixer pressurizes at least the liquid component within the housing and discharges the liquid component through the mixer outlet at a first pressure above hydrostatic pressure. The transfer pump has a pump housing defining a pump inlet to receive a liquid component, a pump outlet, and is devoid of an inlet for receiving a dry component through a gravity feed. The transfer pump receives the liquid component, pressurizes the liquid component within the pump housing, and discharges the liquid component through the pump outlet at a second pressure above hydrostatic pressure.

In another version, a method is described. The method is performed by introducing at least one liquid component to at least one fluid intake port of a blender apparatus. The blender apparatus has a mixer, and a transfer pump mounted on a chassis such that the liquid component is diverted into a first flow directed to a first inlet of the mixer, and second flow directed to a pump inlet of the transfer pump. The transfer pump is devoid of an inlet to receive a dry component through a gravity feed. A dry component is introduced into a second inlet of the mixer. The mixer is operated to create and discharge a slurry of the liquid component and the dry component through a mixer outlet at a first pressure above hydrostatic pressure and to a first discharge port of the blender apparatus. The method is further performed by operating the transfer pump to discharge the liquid component through a pump outlet at a second pressure above hydrostatic pressure and to a second discharge port of the blender apparatus that is separate from the first discharge port.

In another embodiment, a method is described and performed by introducing a first liquid component to at least one fluid intake port of a blender apparatus. The blender apparatus has a mixer and a transfer pump mounted on a chassis such that the liquid component is diverted into a first flow directed to a first inlet of the mixer. The transfer pump is devoid of an inlet to receive a dry component through a gravity feed. The first liquid component is pressurized to a first pressure above hydrostatic pressure. A second liquid component is introduced as a second flow directed to a pump inlet of the transfer pump. The second liquid component is pressurized to a second pressure above hydrostatic pressure. The method is further performed by combining the first and second liquid components in the first and second flows, respectively, prior to discharging the combined first and second liquid components through a fluid discharge port of the blender apparatus.

In another embodiment, a method is described. The method is performed by introducing a first liquid component to at least one fluid intake port of a blender apparatus. The blender apparatus has a mixer, and a transfer pump mounted on a chassis such that the liquid component is diverted into a first flow directed to a first inlet of the mixer. The transfer pump is devoid of an inlet to receive a dry component through a gravity feed. The first liquid component is pressurized to a first pressure above hydrostatic pressure. A second liquid component is introduced as a second flow directed to a pump inlet of the transfer pump. The second liquid component is then pressurized to a second pressure above hydrostatic pressure. The method may then be performed by combining the first and second liquid components in a common manifold after discharging the first and second liquid components through a first fluid discharge port and a second fluid discharge port, respectively, of the blender apparatus.

DETAILED DESCRIPTION

Figure 1:
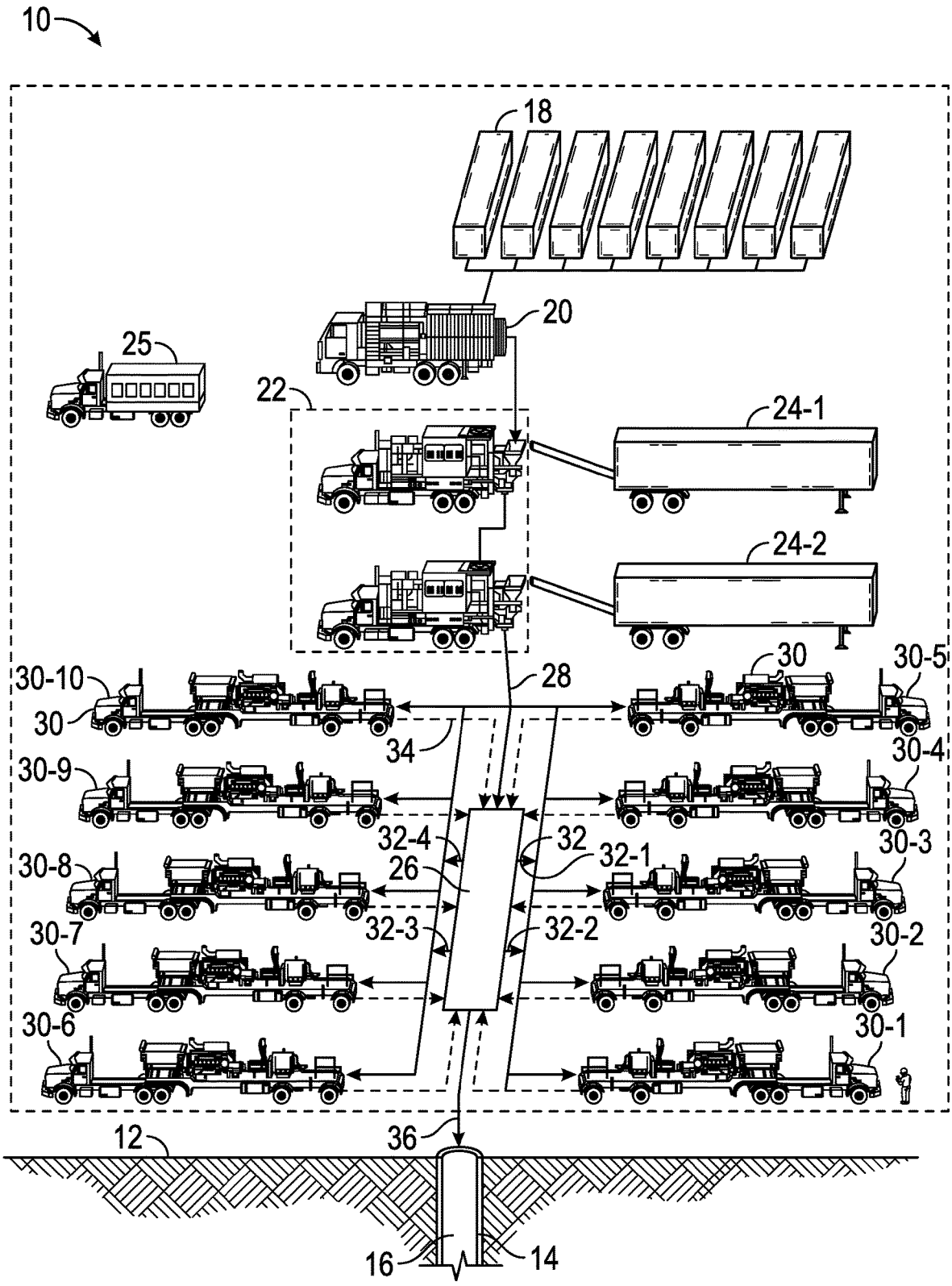
FIG. 1 is a perspective view of an embodiment of an oilfield operation in accordance with the present disclosure.

At the outset, it should be noted that in the development of any such actual embodiment, numerous implementation specific decisions will be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary and this detailed description, each numerical value should be read once as modified by the term "about" (unless already expressly so modified), and then read again as not so modified unless otherwise indicated in context. Also, in the summary and this detailed description, it should be understood that a range listed or described as being useful, suitable, or the like, is intended to include any within the range, including the end points, and is to be considered as having been stated. For example, "a range from 1 to 10" is to be read as indicating each possible number along the continuum between about 1 and about 10. Thus, even if specific data points within the range, or even no data points within the range, are explicitly identified or refer to a few specific, it is to be understood that the inventors appreciate and understand that any data points within the range are to be considered to have been specified, and that inventors possessed knowledge of the entire range and points within the range.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited.

Finally, as used herein any references to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment.

Referring now to the figures, shown in FIG. 1 is an example of an oilfield operation, also known as a job. A well stimulation system 10 is shown for stimulating a formation within a well, such as by pumping a fluid from a surface 12 of a well 14 to a well bore 16 during the oilfield operation. In this particular example, the operation is a hydraulic fracturing operation, and hence the fluid pumped is a fracturing fluid, also called a slurry. As shown, the well stimulation system 10 may include a plurality of water tanks 18, which feed water to a gel maker 20. The gel maker 20 combines water from the water tanks 18 with a gelling agent to form a gel. The gel is then sent to a mixer within at least one blender apparatus 22 where it is mixed with a fibrous material from a fiber feeder 24-1 to make a slurry. The slurry may additionally be mixed with a proppant from a proppant feeder 24-2. The resulting slurry can be used as the fracturing fluid. A computerized control system 25 may be employed to direct at least a portion of the well stimulation system 10 for the duration of a fracturing operation or other stimulation operation. The gelling agent increases the viscosity of the fracturing fluid and allows the proppant to be suspended in the fracturing fluid. It may also act as a friction reducing agent to allow higher pump rates with less frictional pressure.

The well stimulation system 10 may further include a common manifold 26, also referred to herein as a missile trailer or missile, and a stimulation pump 30. The fracturing fluid may then be pumped at low pressure (for example, around 45 to 80 psi) from blenders of the blender apparatus 22 to the common manifold 26, as shown by solid line 28. The common manifold 26 may then distribute the low pressure slurry to a plurality of stimulation pumps 30, also called fracturing pumps, fracturing pumps, plunger pumps, or pumps, as shown by solid lines 32. Each stimulation pump 30 receives the fracturing fluid at a low pressure and discharges it to the common manifold 26 at a high pressure (e.g., between 6,000 PSI and 12,000 PSI) as shown by dashed lines 34. The common manifold 26 then directs the fracturing fluid from the stimulation pumps 30 to the well bore 16 as shown by solid line 36. A plurality of valves on the common manifold 26 may be connected to the stimulation pumps 30. Programs within the computerized control system 25 may be used to automate the valves and automatically pair the valves with the stimulation pumps 30 accurately to create an interlock between the stimulation pumps 30 and the common manifold 26.

The common manifold 26 may have a plurality of inlets and a plurality of outlets. One or more of the inlets can be connected to the blender apparatus 22, and multiples of the inlets and outlets are connected to the stimulation pumps 30. For example, the blender apparatus 22 may be configured to provide a split stream operation in which the blender apparatus 22 is fluidly communicating with the common manifold 26 via two separate flow paths and using two of the inlets of the common manifold 26. In this example, one of the flow paths is used to convey a fracturing fluid such as a slurry and the other flow path is used to convey water to the common manifold 26 which serves to combine the slurry and the water after the slurry and the water have passed through and been pressurized by separate stimulation pumps 30. The common manifold 26 may be fluidly connected to the well bore 16 within the well 14 via a hose 36 connected to one of the plurality of outlets. The fluid connection between the common manifold 26 and the well bore 16 may be used for directing at least one substance into the well bore 16. The at least one substance may be a fracturing fluid, a slurry, an acid, a diluted acid, a stimulation fluid or any fluid used at or suitable for use in an oil field operation. The common manifold 26 may be implemented as a missile trailer, or any other type of manifold capable of receiving substances from a plurality of sources, discharging substances to the plurality of stimulation pumps 30 and discharging the substances under pressure into the well 14.

Figure 2:
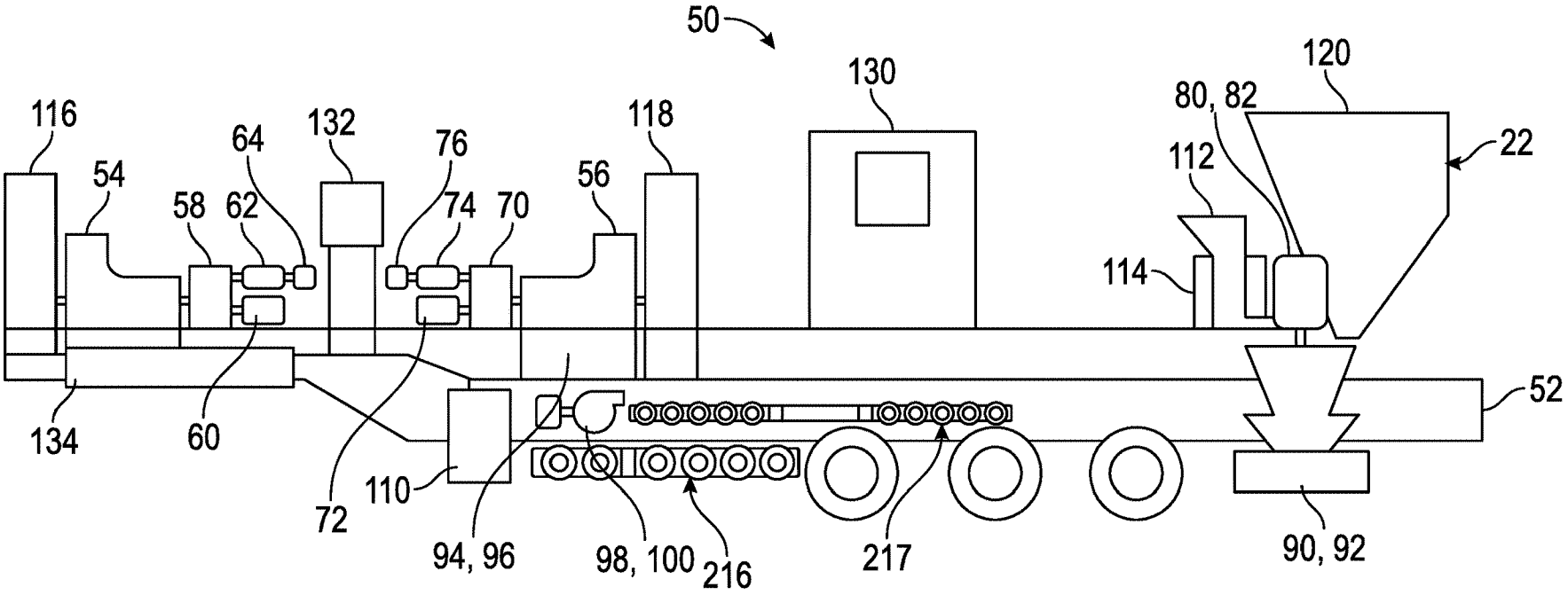
FIG. 2 is a schematic, elevational view of a well servicing unit/apparatus, referred to herein as a blending system having a blender apparatus in accordance with some embodiments of the present disclosure mounted on a chassis.

FIG. 2 shows a schematic, elevational view of a well servicing unit/apparatus, referred to herein as a blending system 50 including the blender apparatus 22 and a chassis 52. As detailed in FIG. 2, the blender apparatus 22 is mounted on the chassis 52, which is designed to be attached to a truck/trailer (not shown). The trailer is used for road transportation of the blender apparatus 22. Although described as a mobile apparatus, the blender apparatus 22 may be a fixed system, or the chassis 52 may be in the form of a skid, for example, for offshore use and operation.

The blender apparatus 22 may include and may be powered by two diesel engines 54 and 56, where one of the engines 54 and 56 drives three pumps, for example. However, one engine may drive one, two, three or more pumps. In the configuration shown, engine 54 is mechanically connected to a gearbox 58, which mechanically transmits power to several hydraulic generators 60, 62 and 64. These hydraulic generators 60, 62 and 64 can be used to power components of the blender apparatus 22. Similarly, engine 56 is connected to the gearbox 70, which transmits the power to several hydraulic generators 72, 74 and 76. The hydraulic generators 72, 74, and 76 are also used to power components of the blender apparatus 22. While the engines 54 and 56 may refer to diesel engines in the present disclosure, it should be understood by one skilled in the art that these engines can be replaced by any power generation device without altering the functionality of the blender apparatus 22.

Hydraulic pumps 60 and 72 may be used to individually drive hydraulic motors 80 and 82. Each hydraulic motor 80 and 82 can be respectively used as a power source to blend fluid in a mixer system 90 and 92, which may be a vortex mixer. Details of the operation of a mixer system 90 and 92 are well known, and will not be discussed in this paper.

Hydraulic pumps 62 and 74 may be used to individually drive hydraulic motors 94 and 96. Each hydraulic motor 94 and 96 can be respectively used as a power source to run transfer pumps 98 and 100, which may be implemented as centrifugal pumps that will be described in more detail hereinafter.

Hydraulic pumps 64 and 76 may be used as a power source to drive a liquid additive systems 110, and solid additive systems, for example, a fiber feeder 112 and dry-additive feeders 114, as well as other auxiliary systems on the blender apparatus 22.

Each of the components 54, 60, 62, 64, 80, and 94 are shown to be connected to a radiator 116, which may be used to reduce the heat of the working fluid. Following a similar layout, each of the components 56, 72, 74, 76, 82, and 96 are also shown to be connected to a radiator 118. Although, shown as "facing each other," the radiators 116 and 118 and their respective layouts may be placed in various other arrangements, for example, side-by-side, which may be limited due to transportation regulations.

Several solid additive systems may be installed near the rear of the blender apparatus 22. For example, the blender apparatus 22 may include a hopper 120 capable of holding and delivering proppant inside the mixers 90 and 92. The fiber feeder system 112 is capable of delivering fibers into the mixers 90 and 92. The blender apparatus 22 may also include the dry-additive feeder system 114 capable of delivering various solid additives into the mixers 90 and the 92.

The blender apparatus 22 may also be equipped with the liquid additive system 110, which is capable of delivering various liquid solutions into the mixers 90 and 92.

The blender apparatus 22 may also include an operator cabin 130 installed near the rear of the blender apparatus 22. The operator cabin 130 can be designed to fit two people, and designed to include the control and monitoring equipment adapted for the operator to run the blender apparatus 22.

The blender apparatus 22 may also be provided with a hydraulic tank system 132 installed to supply hydraulic fluid to the various hydraulic generators 60, 62, 64, 80, 94, 72, 74, 76, 82, and 96, and a fuel tank system 134 may be installed to supply fuel to the diesel engines 54 and 56.

Figure 3:
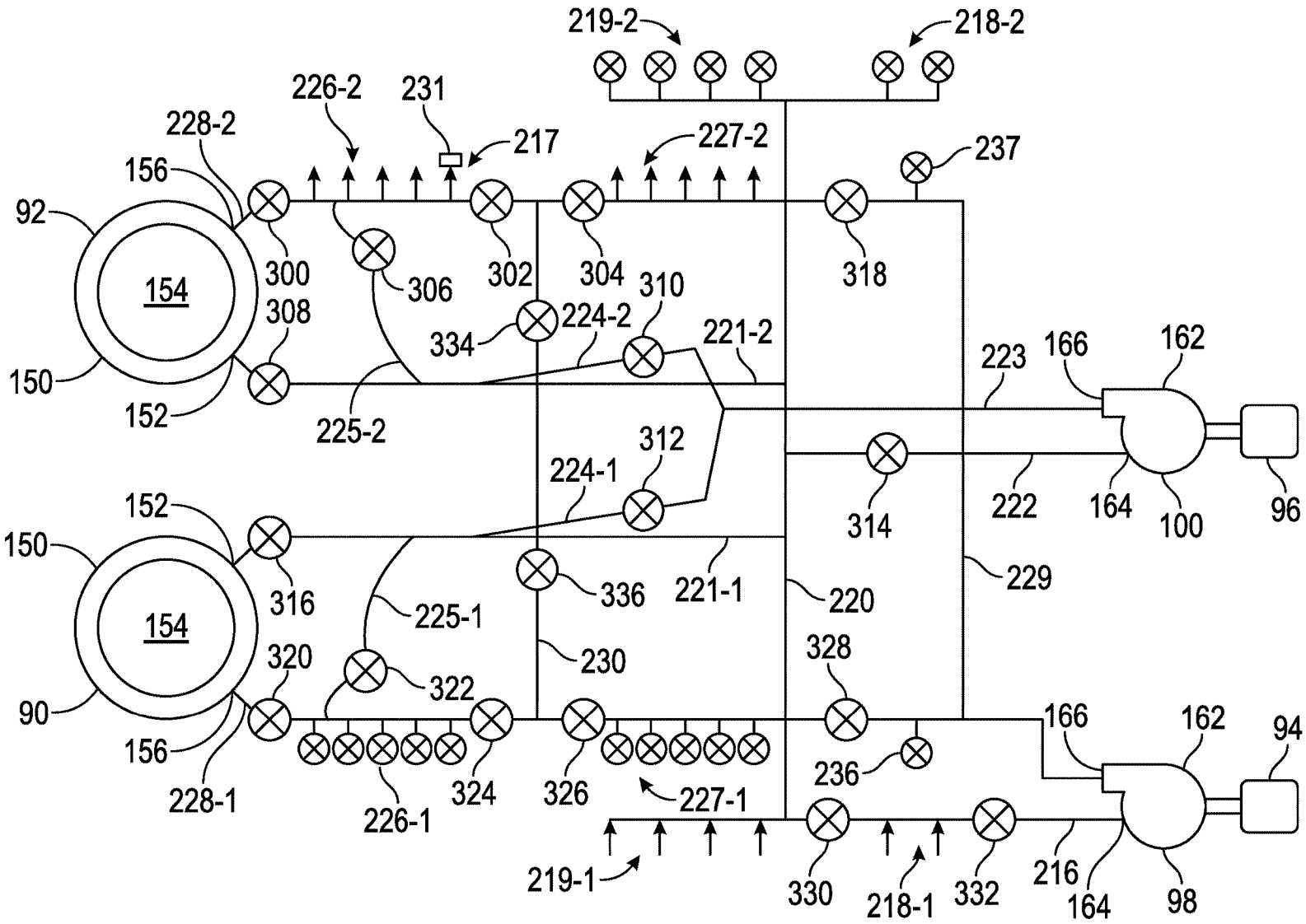
FIG. 3 shows a diagrammatic representation of the blender apparatus in accordance with some embodiments of the present disclosure.

Referring now to FIG. 3, shown therein is a schematic, plan view of a process piping layout of the blender apparatus 22, including the transfer pumps 98 and 100, the mixers 90 and 92, and various valves that will be described hereinafter. Although the well stimulation system 10 may include a plurality of blender apparatus 22, in order to simplify the description, a single blender apparatus 22 will be discussed hereinafter. The mixers 90 and 92 are positioned on the chassis 52, and the transfer pumps 98 and 100 are also positioned on the chassis 52.

The mixers 90 and 92, as will be explained in more detail below, may include a mixer housing 150. The mixer housing 150 may, at least partially, define a first mixer inlet 152, a second mixer inlet 154, and a mixer outlet 156. The first mixer inlet 152 may be configured to receive a liquid component, such as water, a gel, or any other liquid component used or suitable for use at a well 14. The second mixer inlet 154 may be configured to receive a dry component, such as a fiber material or proppant referenced above, sand, or any other dry material or additive used or suitable for use at a well 14. In some embodiments, the mixers 90 and 92 may be configured to mix the dry component into the liquid component to form a slurry, as well as pressurize the slurry within the mixer housing 150 and discharge the slurry through the mixer outlet 156 at a first pressure above hydrostatic pressure. In some embodiments, the first pressure may be between about 45-70 psi. The mixers 90 and 92 may be implemented as programmable optimum density (POD) mixer blenders and may include a centrifugal pump, a vortex pump, an impeller pump, or any other suitable pump capable of receiving the liquid component and the dry component, mixing the liquid component and the dry component together and discharging the mixture at a pressure above hydrostatic pressure.

The transfer pumps 98 and 100 may be provided with a pump housing 162. The pump housing 162 may, at least partially, define a pump inlet 164 and a pump outlet 166. The transfer pumps 98 and 100 may be devoid of an inlet configured to receive a dry component through a gravity feed. The pump inlet 164 may receive the liquid component, such as water, a gel, an acid, or any other liquid material used or suitable for use at a well 14. In some embodiments, the liquid component received by the pump inlet 164 may be different than the liquid component received by the first mixer inlet 152. For example, for acid dilution operations, the pump inlet 164 may receive an acid, while the first mixer inlet 152 may receive water or a gel. The transfer pumps 98 and 100 may be configured to receive the liquid component, pressurize the liquid component within the pump housing 162, and discharge the liquid component through the pump outlet 166 at a second pressure above hydrostatic pressure. In some embodiments, the second pressure may be between about 45-70 psi and may also be within 10% of the first pressure being generated by one or more of the mixers 90 and 92. In some embodiments, the second pressure is less than the first pressure. In some embodiments, the first and second pressures are equal. The transfer pumps 98 and 100 may be implemented as a centrifugal pump, or any other pump capable of receiving, pressurizing, and discharging the liquid component.

FIG. 3 shows a process piping layout of the blender apparatus 22. The blender apparatus is designed to work in a variety of configurations that are implemented by operating certain of the mixers 90 and 92 and transfers pumps 98 and 100, as well as by opening and closing certain of the valves which will be discussed in more detail below. In some embodiments, the blender apparatus 22 is designed to work in four different configurations, including a blending operation, a transfer operation (also referred to herein as a "transfer job"), an acid operation (also referred to herein as an "acid job"), and a split stream operation. A normal blending operation, referred to herein, includes an operation when the blender apparatus 22 provides slurry to a fracturing unit in real-time, or near real-time, as the operation is being performed.

With respect to the transfer operation, in certain operations, fracturing fluid from the mixers 90 and 92 alone are not enough for the job. In the past, separate transfer units were dispatched to handle such scenarios. A transfer unit is a pump based unit that can separately do the function of transferring fluids from a source to the common manifold 26. However, the blender apparatus 22 has been configured to perform the function of a separate transfer unit without affecting the blending functionality and capabilities of the blender apparatus 22.

With respect to the acid operation, depending on the nature of the formation, pre- and post-acid jobs may or may not be used for the well 14. In a general scenario of operation where acid is to be pumped, acid trailers are dispatched on location. These acid trailers act much like the transfer trailers perform the simple operation of facilitating the needed supply of acid. As acid is corrosive, the piping on the acid trailers may include special treatment or coating to be acid resistant. In some embodiments, the blender apparatus 22 is configured to perform the function of the acid trailer without affecting the blending functionality and capabilities of the blender apparatus 22.

With respect to the split stream operation, the split steam operation may include the supply of the slurry from one or more of the mixers 90 and 92 and the continuous supply of slick water (fresh/treated water). In the past, operations of this kind utilized a separate blender and transfer trailer in which the blender was adapted to supply the desired slurry, and the fresh water was often obtained/supplied from the separate transfer trailer. Both fluids were then sent to the common manifold 26 where the fluids were independently pumped into the formation at certain scheduled intervals. Often transfer units were dispatched to handle such scenarios. In some embodiments, the blender apparatus 22 is configured to perform the independent function of the separate transfer trailer without affecting the blending functionality and capabilities of the blender apparatus 22.

Referring again to FIG. 3, in at least one embodiment of the present disclosure, the piping layout of the blender apparatus 22 is such that a fluid intake system 216 and fluid discharge system 217 may be connected through the mixers 90 and 92. Two recirculation lines 225-1 and 225-2 are shown to connect to the fluid intake system 216 to fluid discharge system 217. A drain pipe 231 may be connected to the fluid discharge system 217.

The transfer pump 98 connects the fluid intake system 216 to the fluid discharge system 217. The transfer pump 98 is capable of transferring fluid directly from the fluid intake system 216 to the fluid discharge system 217, by-passing the mixers 90 and 92. While the transfer pumps 98 and 100 may be described herein as centrifugal pumps in the present disclosure, it should be understood by one skilled in the art that the transfer pumps 98 and 100 can be implemented by any fluid displacement device, such as positive displacement pumps, axial pumps and the like, without altering the functionality of the blender apparatus 22.

The fluid intake system 216 may include six fluid intake ports 218-1, 218-2, 219-1 and 219-2 and be disposed on each side of the blender apparatus. The fluid intake ports 218-1, 218-2 219-1 and 219-2 may be connected to a main intake manifold 220, which may be connected to mixer suction pipes 221-1 and 221-2 and a transfer pump intake pipe 222. The mixer suction pipes 221-1 and 221-2 may be directly connected to the mixers 90 and 92, respectively. The transfer pump intake pipe 222 may be connected to the transfer pump 100, which is connected to a transfer pump discharge 223. The transfer pump discharge 223 may split into two jet pipes 224-1 and 224-2, which are respectively connected to the mixer suction pipes 221-1 and 221-2, functioning to further boost the pressure of the fluid leading to the mixers 90 and 92. The transfer pump 100 is capable of transferring fluid directly from transfer pump intake pipe 222 to mixer suction pipes 221-1 and 221-2 through the jet pipes 224-1 and 224-2. It will also be noted that the main intake manifold 220 may be connected to the pump inlet 164 of the transfer pump 98.

In the configuration shown in FIG. 3, the fluid intake ports 218-1, 218-2, 219-1 and 219-2 may have an approximate diameter of 8", the main intake manifold 220 may have an approximate diameter of 12", the mixer suction pipes 221-1 and 221-2 may have an approximate diameter from 8" to 10", and the transfer pump intake 222 may have an approximate diameter of 8", the transfer pump discharge 223 of 6" and the jet pipes 224-1 and 224-2 of 3".

As shown in FIG. 3, the fluid discharge system 217 is shown to include discharge ports 226-1, 226-2 227-1 and 227-2 on each side of the blender apparatus 22, and two additional transfer pump discharge ports 236 and 237. Each of the discharge ports 226-1, 226-2, 227-1 and 227-2 may be individually referred to as a first discharge port, a second discharge port, or the like, as will be appreciated by those skilled in the art. The discharge ports 226-1 and 227-1 may be connected to the mixer discharge pipe 228-1. The discharge ports 226-2 and 227-2 may be connected to the mixer discharge pipe 228-2. The mixer discharge pipes 228-1 and 228-2 may be respectively connected to the mixer outlets 156 of the mixers 90 and 92. The mixer discharge pipe 228-1 is also connected to the discharge port of the transfer pump 98. Two crossover pipes 229 and 230 connect mixer discharge pipe 228-1 to the mixer discharge pipe 228-2.

In the configuration shown in FIG. 3, the discharge ports 226-1, 226-2, 227-1 and 227-2 may have an approximate diameter of 6", and in some embodiments an approximate diameter of 4", the mixer discharge pipes 228-1 and 228-2 of 6", the crossover pipes 229 and 230 of 6", and a drain pipe (not shown) of 4".

It will be noted that specific details with respect to the connections of the blender apparatus 22 to its environment—fluid supply and discharge network, solid supply—will not be detailed herein as such are well within the knowledge of those skilled in the art.

While the reference numerals 60, 72, 62 and 74 refer to pumps, and 80, 82, 94 and 96 refer to motors in the present disclosure, it should be understood by one skilled in the art that these components can be replaced by any configuration that may transmit mechanical power to the mixers 90 and 92; and transfer pumps 98 and 100 without altering the functionality of the blender apparatus 22.

As mentioned above, the blender apparatus 22 is capable of running multiple operations using a system of valves. In some embodiments, the blender apparatus 22 is provided with the following valves, however, it should be understood that other configurations of valves and placement of valves could be used: a road side vortex discharge valve 300, a road side discharge vortex partition valve 302, a road side discharge engine partition valve 304, a road side recirculation valve 306, a road side vortex suction valve 308, a road side boost jet valve 310, a curb side boost jet valve 312, a road side transfer pump suction valve 314, a curb side vortex suction valve 316, a curb side transfer pump discharge valve 318, a curb side vortex discharge valve 320, a curb side recirculation valve 322, a curb side discharge vortex partition valve 324, a curb side discharge engine partition valve 326, a curb side transfer pump discharge valve 328, a curb side suction manifold partition valve 330, a curb side transfer pump suction valve 332, a road side cross-over isolation valve 334, and a curb side cross-over isolation valve 336.

As discussed above, the blender apparatus 22 may be configured to perform a blending operation, for example to provide a slurry to other equipment during a fracturing operation. To place the blender apparatus 22 into a proper configuration to form a blending operation, valves 300, 308, 320, 316, 324, 304, 330,314, 310, 312, 336 and 334 are open and valves 306, 322, 302, 326, 332, 328, and 318 are closed.

As detailed above, in a so called "conventional blending operation", fresh fluid enters the blender apparatus 22 through the intake ports 218-1 and 219-1, and then circulates through the main intake manifold 220. The fluid stream splits inside the main intake manifold 220. Some of the flow is pulled by the transfer pump 100 through the transfer pump intake pipe 222; the remainder of the flow circulates directly through the mixer intake pipe 221-1 and 221-2. The transfer pump 100 discharges the flow pulled directly into the mixer intake pipes 221-1 and 221-2, through the transfer pump discharge pipe 223, and the two jet pipes 224-1 and 224-2.

The transfer pump 100 discharges the fluid in the transfer pump discharge pipe 223, with an increased pressure. Due to the relatively small diameter of the jet pipes 224-1 and 224-2 (3" in the application disclosed), the velocity of the flow is increased while circulating through the jet pipes 224-1 and 224-2. The fluid stream then enters the mixer intake pipes 221-1 and 221-2 with an increased velocity. When entering the mixer intake pipe 221-1 and 221-2, the highly energized stream coming from the jet pipes 224-1 and 224-2 increases the pressure, and therefore the flow rate of the main stream flow circulating in the mixer intake pipe 221-1 and 221-2.

Continuing through the mixer intake pipes 221-1 and 221-2, the fluid flows towards the mixers 90 and 92, where it is blended with sand delivered by the sand hopper 120, various solid additives from the dry add systems 112 and 126, and liquid additives delivered by the liquid additive systems 110. It will be noted that the fiber feeders 112 are capable of delivering fiber into the mixers 90 and 92 at a very high flow rate.

After blending, the slurry (mix of water, liquid and solid additives) created in the mixers 90 and 92 is respectively discharged into the mixer discharge pipes 228-1 and 228-2. Continuing through the mixer discharge pipes 228-1, and the crossover pipe 230, the slurry flows towards the discharge port 226-2. Continuing through the mixer discharge pipe 228-2, the slurry flows towards the discharge ports 227-2. The slurry is discharged to the common manifold 26 through the discharge polls 226-2 and 227-2.

In a "conventional blending operation", the blender apparatus 22 is capable of mixing and discharging a flow rate [x] of slurry. The flow rate [x] may be 10 BPM, 100 BPM, 1000 BPM or the like. The flow rate [x] of slurry in the present disclosure is dependent upon the pumps and equipment used on the blender apparatus 22, and will vary with the same.

It will be noted that FIG. 3 describes one specific way of performing a "conventional blending operation". However, if desired, a similar operation can be performed using different fluid intakes ports 218-1, 218-2, 219-1 or 219-2, and discharge ports 226-1, 226-2, 227-1 or 227-2 combinations.

In some applications, for example applications which do not involve a specifically achievable slurry flow rate, it is contemplated to bypass the transfer pump 100. This can be achieved by closing the valves 314, 310 and 312. The blender apparatus 22 is capable of using a single mixer 90 or 92, which may also enable low flow rate applications.

In some applications, it can be deemed desirable to allow fluid to circulate through the recirculation lines 225-1 and 225-2. To do so, valves 322 and 306 are left open.

To configure the blender apparatus 22 to perform a transfer job, valves 300, 308, 320, 316, 324, 304, 314, 310, 312, 332, 328, 336 and 334 are open and valves 306, 322, 302, 326, 318 and 330 are closed.

A so called "transfer job" is the combination of two independent operations: conventional blending operation, and transfer of fresh fluid from intake to discharge.

The first independent operation of a "transfer job" is a conventional blending operation. As detailed in FIG. 3, during this operation, fresh fluid enters the blender apparatus 22 through intake polls 218-2 and 219-2, and then circulates through the main intake manifold 220. The fluid stream splits inside the main intake manifold 220. Some of the flow is pulled by the transfer pump 100 through the centrifugal pump intake pipe 222; the remainder circulates directly through the mixer intake pipe 221-1 and 221-2. The transfer pump 100 discharges the flow pulled directly into the mixer intake pipe 221-1 and 221-2, through the transfer pump discharge pipe 223, and the two jet pipes 224-1 and 224-2.

Continuing through the mixer intake pipe 221-1 and 221-2, the fluid flows towards the mixers 90 and 92, where it is blended with sand delivered by the sand hopper 120, various solid additives from the dry add systems 112 and 126, and liquid additives delivered by the liquid additive systems 110.

After blending, the slurry (mix of water, liquid and solid additives) created in the mixers 90 and 92 is respectively discharged into the mixer discharge pipes 228-1 and 228-2. Continuing through the mixer discharge pipes 228-1, and the crossover pipe 230, the slurry flows towards the discharge ports 226-2. Continuing through the mixer discharge pipes 228-2, the slurry flows towards the discharge ports 227-2. The slurry is discharged to the common manifold 26 through the ports 227-2 and 228-2.

The second independent operation of a "transfer job" is a transfer of fresh fluid. During this operation, fresh fluid enters the blender apparatus 22 through the intake ports 218-1. The flow is pulled by the transfer pump 98 and discharged into the mixer discharge pipe 228-1. Fresh fluid then flows towards the discharge ports 227-1 and a centrifugal pump curb side discharge port, for example, 236, where the fresh fluid may be discharged to a transfer trailer, for example.

In a "transfer job", the blender apparatus 22 is both capable of mixing and discharging a flow rate of slurry [y] to the common manifold 26, and transferring a flow rate [x] of fresh fluid to the transfer trailer. The values of the flow rates [x] and [y] are up to the pump capacity. While in the configuration detailed, the flow rate [y] is limited to 100 BPM, and [x] is limited to 50 BPM, this value is dependent upon the pumps and equipments used on the blender apparatus 22, and will vary with the same.

It will be noted that the description above denotes a way to perform a "transfer job". However, if desired, the same operation can be performed using different fluid intakes ports 218-1, 218-2, 219-1 or 219-2, and discharge ports 226-1, 226-2, 227-1 or 227-2 combinations.

In some applications, for example applications which do not involve a specifically achievable slurry flow rate, it is contemplated to bypass the transfer pump 100. This can be achieved by closing the valves 314, 310 and 312. The blender apparatus 22 is capable of using a single mixer 90 or 92, which may also perform low flow rate applications.

In some applications, it can be deemed desirable to allow fluid to circulate through the recirculation lines 225-1 and 225-2. To do so, valves 322 and 306 are left open.

To perform an acid job with the blender apparatus 22, the valve 332 is opened and the other valves 300, 302, 304, 306, 308, 310, 312, 314, 316, 318, 320, 322, 324, 326, 328, 330, 334 and 336 are closed.

During an "acid job", acid enters the blender apparatus 22 through the intake ports 218-1. The flow is pulled by the transfer pump 98 and discharged into the cross-over pipe 229, towards a centrifugal pump curb side discharge port 237, where the acid is discharged to the environment. In an "acid job", the blender apparatus 22 is capable of mixing and discharging a flow rate [x] of acid. The flow rate [x] may be 10 BPM, 50 BPM, 500 BPM or the like. The flow rate [x] of slurry in the present disclosure is dependent upon the pumps and equipment used on the blender apparatus 22, and will vary with the same.

It will be noted that the description above shows one specific way of performing an "acid job." However, if desired, the same operation can be performed using a different fluid discharge port 236, rather than the centrifugal pump curb side discharge port 237. It should also be noted, that the blender apparatus 22 may include special treatment or coating to be acid resistant.

To perform a split stream operation, valves 332, 328, 326, 304, 300, 308, 314, 310, 336 and 334 are open and valves 306, 322, 302, 318, 330, 320, 316, 324 and 312 are closed.

A "split stream operation" comprises the combination of two independent operations: conventional blending operation, and transfer of fresh water from intake to discharge.

A split steam operation may include the supply of the slurry from a blender and the continuous supply of slick water (fresh/treated water). In an operation of this kind, the blender apparatus 22 may be adapted to supply the desired slurry, as well as the fresh water. Both fluids are then sent to the common manifold 26 where the fluids are independently pumped into the formation at certain scheduled intervals.

The first independent operation of a "split stream operation" is a conventional blending operation. During this operation, fresh fluid enters the blender apparatus 22 through the intake ports 218-2 and 219-2, and then circulates through the main intake manifold 220. The fluid stream splits inside the main intake manifold 220. Some of the flow is pulled by the transfer pump 100 through the centrifugal pump intake pipe 222; the remainder circulates directly through the mixer intake pipe 221-2. The transfer pump 100 discharges the flow pulled directly into the mixer intake pipe 221-2, through the transfer pump discharge pipe 223, and the jet pipe 224-2.

Continuing through the mixer intake pipe 221-2, the fluid flows towards the mixer 92, where the fluid is blended with sand delivered by the sand hopper 120, various solid additives from the dry add systems 112 and 126, and liquid additives delivered by the liquid additive systems 110.

After blending, the slurry created (mix of water, liquid and solid additives) is discharged into the mixer discharge pipes 228-2. Continuing through the mixer discharge pipes 228-2, the slurry flows towards the discharge ports 226-2, where it is discharged to the common manifold 26.

The second independent operation of a "split stream operation" is a transfer of fresh fluid. During this operation, fresh fluid enters the blender apparatus 22 through the intake ports 218-1. The flow is pulled by the transfer pump 98 and discharged into the mixer discharge pipe 228-1. Fluid flows through the cross-over pipe 230, towards the discharge polls 227-2, where it is discharged to the common manifold 26.

In a "split stream operation", the blender apparatus 22 is both capable of mixing and discharging a flow rate [y] of slurry to the common manifold 26, and transferring a flow rate [x] of fresh fluid to the transfer trailer. The values of the flow rates [x] and [y] are up to the pump capacity, and will vary as being dependent upon the pumps and equipment used on the blender apparatus 22. For example, in the configuration detailed, the flow rate [y] may be limited to 10 BPM, 50 BPM, or 500 BPM and [x] may be limited to 5 BPM, 50 BPM, or 500 BPM.

The above description describes one specific way of performing a "split stream operation" in which both mixers 90 and 92 are used. However, if desired, the same operation can be performed using different fluid intakes polls 218-1, 218-2, 219-1 or 219-2, and discharge ports 226-1, 226-2, 227-1 or 227-2 combinations. Also, in the schematic shown, the blending operation occurs in the mixer 92. However, the blender apparatus 22 can be configured to perform this operation in the mixer 90 instead. Additionally, the blender apparatus 22 may also be configured to perform this operation in mixers 90 and 92 simultaneously.

In some applications, for example applications which do not involve a specifically achievable slurry flow rate, it is contemplated to bypass the transfer pump 100. This can be achieved by closing the valves 314, 310 and 312.

In some applications, it can be deemed desirable to allow fluid to circulate through the recirculation lines 225-1 and 225-2. To do so, valves 322 and 306 are left open.

In embodiments having the at least one fluid intake port 218-1, 218-2, 219-1 or 219-2 and at least two fluid discharge ports 226-1, 226-2, 227-1, and/or 227-2, the fluid intake port 218-1, 218-2, 219-1 or 219-2 and the fluid discharge ports 226-1, 226-2, 227-1, and/or 227-2, may be any connection port suitable for receiving the liquid component. In some embodiments, certain of the at least one fluid intake port 218-1, 218-2, 219-1 or 219-2 and certain of the at least two fluid discharge ports 226-1, 226-2, 227-1, and/or 227-2 may include an anti-corrosion coating covering at least a portion of an interior (not shown), such that certain of the at least one fluid intake port 218-1, 218-2, 219-1 or 219-2 and certain of the at least two fluid discharge ports 226-1, 226-2, 227-1, and/or 227-2 may be resistant to corrosion from substances such as acids, salt, or any other materials used in oil field operations capable of corroding piping, ports, etc. Further, it should be understood that the valve 330 can be used to place certain of the fluid intake ports 218-1, 218-2, 219-1 or 219-2 with other fluid intake ports 218-1, 218-2, 219-1 or 219-2.

The dry component may be a fiber, a pelletized fiber, fibrous material, or other material capable of forming a matrix within a slurry to aid in the implementation of the hydraulic fracturing operation or well stimulation operation. In other embodiments, the dry component may be a dry surfactant, a breaker capable of breaking down gel polymer chains of the liquid component, or any other oilfield material. In one embodiment, the dry component may be a proppant, such as sand, silica, or quartz sand, that when mixed into the slurry may create a fracturing fluid where a first dry component forms a matrix within the slurry to enable retention of a second dry component within fractures formed in a formation around the well 14. The second dry component may also be a breaker, a dry surfactant, or other oilfield material. In some embodiments the first and second dry components may be the same dry component or similar oilfield material. In certain other embodiments, the first and second dry components may be differing oilfield materials.

In some embodiments, the blender apparatus 22 may have a single mixer 90 and a plurality of transfer pumps 98 and 100, wherein the transfer pump 100 is in fluid communication with at least one of the fluid intake ports 46 and the first mixer inlet 152 of the single mixer 90 and the other one of the transfer pumps 44 is in fluid communication with the at least one fluid intake port 46 but not the mixer 92. As such, one skilled in the art will understand that the blender apparatus 22 may be provided with any number or combination of mixers and transfer pumps with varying states of fluid communication therebetween, provided the blender apparatus 22 has the at least one mixer 90 and the at least one transfer pump 98 or 100.

Although the preceding description has been described herein with reference to particular means, materials, and embodiments, it is not intended to be limited to the particulars disclosed herein; rather, it extends to functionally equivalent structures, methods, and uses, such as are within the scope of the appended claims.

What is claimed is:

1. A blending system, comprising:

a chassis;

a blender apparatus comprising:

a mixer positioned on the chassis, the mixer having a mixer housing defining a first mixer inlet, a second mixer inlet and a mixer outlet, the first mixer inlet configured to receive a liquid component, and the second mixer inlet configured to receive a dry component, the mixer configured to pressurize at least the liquid component within the mixer housing and discharge the liquid component through the mixer outlet at a first pressure above hydrostatic pressure;

a transfer pump positioned on the chassis, the transfer pump having a pump housing defining a pump inlet to receive a liquid component and a pump outlet to discharge the liquid component, the transfer pump configured to receive the liquid component, pressurize the liquid component within the pump housing, and discharge the liquid component through the pump outlet at a second pressure above hydrostatic pressure;

at least two fluid intake ports including a first fluid intake port in fluid communication with the first mixer inlet and a second fluid intake port in fluid communication with the pump inlet;

at least two discharge ports including a first discharge port in fluid communication with the mixer outlet and a second discharge port in fluid communication with the pump outlet; and a valve having an open position and a closed position, wherein the open position places the first fluid intake port in fluid communication with the second fluid intake port.

2. The blending system of claim 1, wherein the first pressure is between 45-70 psi.

3. The blending system of claim 1, wherein the first pressure is within 10% of the second pressure.

4. The blending system of claim 1, wherein the transfer pump is a first transfer pump, and further comprising a second transfer pump positioned on the chassis, the second transfer pump having a pump housing defining a pump inlet to receive a liquid component and a pump outlet to discharge the liquid component, wherein the pump inlet of the second transfer pump is in communication with the at least one fluid intake port, and the pump outlet of the second transfer pump is in communication with the first mixer inlet.

5. The blender apparatus of claim 1, wherein the mixer is a first mixer, and further comprising: a second mixer positioned on the chassis, the second mixer having a mixer housing defining a first mixer inlet, a second mixer inlet and a mixer outlet, the first mixer inlet configured to receive a liquid component, and the second mixer inlet configured to receive a dry component; a first valve having an open position and a closed position, wherein the open position of the first valve places the pump outlet of the transfer pump in fluid communication with the first mixer inlet of the second mixer; and a second valve having an open position and a closed position, wherein the closed position of the second valve blocks fluid communication between the pump outlet of the transfer pump and the mixer outlet of the second mixer.

6. The blender apparatus of claim 1, wherein the transfer pump is a first transfer pump and the blending apparatus further comprises a second transfer pump positioned on the chassis in fluid communication with the first mixer inlet, the second transfer pump having a pump housing defining a pump inlet to receive a liquid component and a pump outlet in fluid communication with the first mixer inlet to discharge the liquid component, the second transfer pump configured to receive the liquid component, pressurize the liquid component within the pump housing, and discharge the liquid component through the pump outlet to the first mixer inlet at a third pressure above hydrostatic pressure.

7. A blending system, comprising:

a chassis;

a blender apparatus comprising:

a first mixer positioned on the chassis, the first mixer having a mixer housing defining a first mixer inlet, a second mixer inlet and a mixer outlet, the first mixer inlet configured to receive a liquid component, and the second mixer inlet configured to receive a dry component, the first mixer configured to pressurize at least the liquid component within the mixer housing and discharge the liquid component through the mixer outlet at a pressure above hydrostatic pressure;

a second mixer positioned on the chassis, the second mixer having a mixer housing defining a first mixer inlet, a second mixer inlet and a mixer outlet, the first mixer inlet configured to receive a liquid component, and the second mixer inlet configured to receive a dry component, the second mixer configured to pressurize at least the liquid component within the mixer housing and discharge the liquid component through the mixer outlet at a pressure above hydrostatic pressure;

a transfer pump positioned on the chassis, the transfer pump having a pump housing defining a pump inlet to receive a liquid component and a pump outlet to discharge the liquid component, the transfer pump configured to receive the liquid component, pressurize the liquid component within the pump housing, and discharge the liquid component through the pump outlet at a second pressure above hydrostatic pressure;

a first valve having an open position and a closed position, wherein the open position of the first valve places the pump outlet of the transfer pump in fluid communication with the first mixer inlet of the second mixer; and a second valve having an open position and a closed position, wherein the closed position of the second valve blocks fluid communication between the pump outlet of the transfer pump and the mixer outlet of the second mixer.

8. The blending system of claim 7, wherein the first pressure is between 45-70 psi.

9. The blending system of claim 7, wherein the first pressure is within 10% of the second pressure.

10. The blending system of claim 7, further comprising at least one fluid intake port in fluid communication with the first mixer inlet and the pump inlet; and at least two discharge ports including a first discharge port in fluid communication with the mixer outlet and a second discharge port in fluid communication with the pump outlet.

11. The blending system of claim 10, wherein the at least one fluid intake port comprises a first fluid intake port and a second fluid intake port, and further comprising a valve having an open position and a closed position, wherein the open position places the first fluid intake port in fluid communication with the second fluid intake port.

12. The blending system of claim 10, wherein the transfer pump is a first transfer pump, and further comprising a second transfer pump positioned on the chassis, the second transfer pump having a pump housing defining a pump inlet to receive a liquid component and a pump outlet to discharge the liquid component, the pump inlet of the second transfer pump is in communication with the at least one fluid intake port, and the pump outlet of the second transfer pump in communication with the first mixer inlet.

13. The blender apparatus of claim 7, wherein the transfer pump is a first transfer pump and the blending apparatus further comprises a second transfer pump positioned on the chassis in fluid communication with the first mixer inlet, the second transfer pump having a pump housing defining a pump inlet to receive a liquid component and a pump outlet in fluid communication with the first mixer inlet to discharge the liquid component, the second transfer pump configured to receive the liquid component, pressurize the liquid component within the pump housing, and discharge the liquid component through the pump outlet to the first mixer inlet at a third pressure above hydrostatic pressure.

* * * * *